US005448846A

United States Patent [19]

Peterson et al.

[11] Patent Number: 5,448,846

[45] Date of Patent: Sep. 12, 1995

[54] IDENTIFICATION DEVICE FOR MACHINE IMPRINTING

[75] Inventors: Dean D. Peterson, Sylmar; Walter W. Mosher, Jr., West Hills, both of Calif.

[73] Assignee: Precision Dynamics Corporation, San Fernando, Calif.

[21] Appl. No.: 172,855

[22] Filed: Dec. 23, 1993

Related U.S. Application Data

[63] Continuation of Ser. No. 866,325, Apr. 9, 1992, abandoned.

[51] Int. Cl.[6] ..... A44C 5/00

[52] U.S. Cl. ..... 40/633; 40/665; 24/484

[58] Field of Search ..... 40/304, 663, 664, 665, 40/633; 63/2, 3, DIG. 3; 24/16 R, 484; 292/307 R, 308, 314, 325; 283/75

[56] References Cited

U.S. PATENT DOCUMENTS

| | | | |
|---|---|---|---|
| 4,221,063 | 9/1980 | Charles et al. | 40/304 X |
| 4,783,917 | 11/1988 | Smith et al. | 40/633 |
| 5,018,286 | 5/1991 | Zahner | 40/664 X |

*Primary Examiner*—Brian K. Green
*Attorney, Agent, or Firm*—Thomas P. Mahoney

[57] ABSTRACT

An identification device which includes a band having a blank imprintable surface upon which information in the form of a bar code or the like can be imprinted on a conventional bar code imprinting machine. Various bands are provided with separate fasteners which are assembled with the band after the imprinting and which, when the band is located on a person or object, lock the band against undesirable removal of the band.

6 Claims, 9 Drawing Sheets

IDENTIFICATION DEVICE FOR MACHINE IMPRINTING

This is a continuation of application Ser. No. 07/866,325, filed Apr. 9, 1992, which is being abandoned.

This invention relates to an identification device and, more particularly, to an identification device which is intended to be provided to the institution or business utilizing the device in such a manner that it may ultimately be imprinted with a bar code which will identify the person or object to whom the identification device is applied.

BACKGROUND OF THE INVENTION

The prior art discloses numerous identification bands for hospital patient identification, crowd control, and object identification.

Exemplary of the identification bands of the prior art are U.S. Pat. No. 2,893,143, which discloses a flexible identification band incorporating inaccessible fastener means so that the band cannot be removed from the object on which it is utilized; U.S. Pat. No. 2,954,621 which discloses an identification band utilizing a locking snap fastener of the type disclosed in U.S. Pat. No. 2,941,270, said snap fastener being intended to prevent the removal of the band from operative engagement with the object it encompasses; and U.S. Pat. No. 3,059,359 which discloses an alternative band construction also incorporating a self-locking fastener.

Another type of self-locking snap fastener is disclosed in U.S. Pat. No. 3,551,963 and can be used in the '359 and '621 bands in substitution for the originally utilized fasteners.

Pertinent also are the teachings of U.S. Pat. Nos. 4,285,146; 4,318,234; and 4,386,795, which disclose an identification device designed to be utilized in conjunction with various types of fasteners intended to permanently secure the device about the object being identified and prevent its removal unless it is severed by cutting or other means of severance.

All of the cited patents relate to identification devices and fasteners therefor which prevent tampering with the band to cause its unauthorized removal.

The other aspect of the prior art devices is the incorporation in or on the devices of information relating to the object displaying the band. For instance, in patient identification, prior art usages include the insertion of an information card in a pocket in the band; handwritten information on an inscribable surface of the band; typed information on a surface of the band and the like.

However, recent developments in the art of storing and imparting information have led to the utilization of bar codes or magnetic means of storing information in or upon the bands of identification devices. Particularly, in the case of bar codes, it is necessary to feed the identification devices constituted by the bands through a bar code imprinter which will not receive bands having fastener means incorporated therein because of the inherent limitations of the bar code imprinter. The identification device of the present invention is intended to provide a band which is particularly adapted for use in bar code imprinters.

OBJECTS AND ADVANTAGES OF THE INVENTION

It is, therefore, an object of our invention to provide an identification device which includes a band securable in operative relationship with an object to be identified by separate fastener means, said band being provided with an intermediate surface inscribable with a bar code and having opposite extremities which are disposable in overlying relationship with each other to permit the engagement thereof by a suitable locking fastener after the bar code has been imprinted upon the band.

Another object of the invention is the provision of a band of the aforementioned character which includes fastener locating means or openings intended to locate and mount a separate fastener in operative relationship with the band and to permit the fastener to co-act with the opposite extremities of the band to maintain said band in a tamper-proof relationship with the object encompassed by the band.

A further object of the invention is the provision of a band of the aforementioned character which co-acts with fastener means having detent means which includes detent and locking functions and the component parts of which are maintained in operative relationship by an integral tether or hinge which maintains the component parts of the fastener for easy mounting in operative relationship with the respective extremity of the band and for easy engagement with the band to cause it to be installed in a tamper-proof manner upon the identified object.

An additional object of the invention is the provision of a band which, in several of its embodiments, is infinitely adjustable to permit it to be applied to different sizes of individual or objects within a very broad range.

Another object of the invention is the provision of a band of the aforementioned character which can be provided in a variety of configurations, that is, a band which can be provided with a plurality of similar bands in shape, roll, or individual band form.

BRIEF DESCRIPTION OF THE DRAWINGS

Other objects and advantages of the invention will be apparent from the following specification and the accompanying drawings, which are for the purpose of illustration only, and in which.

DESCRIPTION OF EMBODIMENTS OF THE INVENTION

Before proceeding with a detailed description of the embodiments of the invention, it is important that an appreciation be had of the various environments in which the identification device consisting of the various bands and fastener means disclosed hereinbelow are utilized.

For instance, one of the most intensive areas of utilization is for hospital patient identification. In the present state of the art, the prior art constructions discussed hereinabove are being supplanted by the imprinting on the band of bar codes, magnetic strips, or the like eliminating the prior art utilization of insertion cards, typewriting, and other means of conveying information.

The bands are also widely used in other environments such as penal institutions or mental hospitals. Because of the significantly different utilization considerations, and because of the need for providing different types of bands and fasteners, the present invention is disclosed in the form of a preferred and ancillary embodiments which enables the ultimate applier of the identification devices to choose from a wide variety of bands and fasteners constituting the identification devices.

Figure 1:
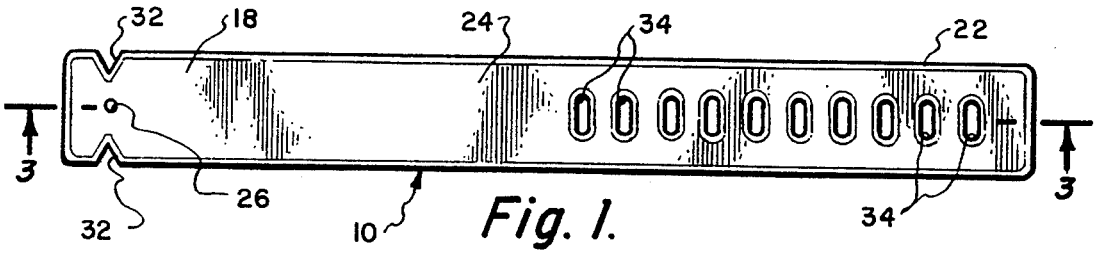
FIG. 1 is a top plan view of preferred embodiment of the band.
Figure 6:
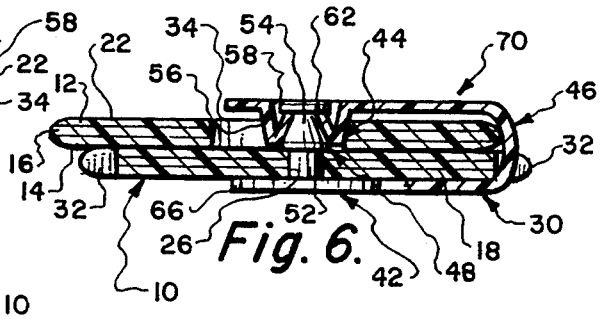
FIG. 6 is a transverse sectional view taken on the broken line 6—6 of FIG. 5.

Referring to the drawings, and particularly to FIG. 1 thereof, We show a band blank 10 which constitutes a portion of the identification device, said band being fabricated from laminae of synthetic plastic sheeting, frequently including two outer laminae 12 and 14 and an intermediate lamina 16, FIG. 6.

The band 10 is generally of elongated, rectangular configuration and includes first and second extremities 18 and 22 respectively defining therebetween an intermediate inscribable portion or surface 24 for a purpose which will be described in greater detail below.

Provided in the first end portion, or extremity 18, of the band 10 is a mounting and locating opening 26 for mounting a fastener 30 of the identification device in operative relationship with the band 10, in a manner to be described in greater detail below.

Also formed in the edges of the first end portion of the band 10 are recesses 32 whose function will become apparent from the ensuing description of the invention. It is contemplated that, in some applications, a plurality of separate band blanks similar to the band blank 10 of FIG. 1 can be provided to the user. However, it is also contemplated that the blanks be provided in roll form and be separable from each other as they are translated through a bar code printing machine or the like. In addition, the bands can be provided in sheet form and be fed into the machine in that form.

A plurality of linearly spaced elongated openings 34 is provided in the second end portion, or extremity, of the band 10 and the number of said openings is dependent upon the contemplated usage of the identification device constituted by the band 10 and fastener 30.

The bar code imprint 40 is imprinted on the intermediate inscribable area 24 of the band blank 10 by inserting a band blank 10 in the imprinting machine or by mounting a roll or a plurality of sheets of blanks in operative relationship with the machine.

As previously mentioned, the bar code 40 contains information relative to the person or object upon whom or which the band 10 is utilized. The fact that the band blank 10 does not incorporate fastening means permits it to be received in the bar code imprinting machine and the fastener 30, to be described in detail below, is subsequently assembled in operative relationship with the band blank 10 bearing the bar code 40.

As previously mentioned, the fastener means 30 includes a first fastener portion 42 and a second fastener portion 44, said first and second portions being maintained in operative relationship with each other by tether or hinge means 46 formed integrally therewith. The fastener 44 can be fabricated from any suitable synthetic plastic including polypropylene, high-density polyethylene, and the like. In certain applications, it is conceivable that the fastener 30 can be fabricated from characteristically resilient and deformable metals such as light-gauge stainless steel.

The fastener means 30 can be formed by injection molding from the aforesaid plastics which have the necessary flexibility, deformability, and basic adaptability for use in conjunction with the band blank 10. Formed integrally with the first fastener portion is detent means 48, said detent means including a cylindrical shank 52 and locking head 54 of frusto-conical configuration.

Figure 2:
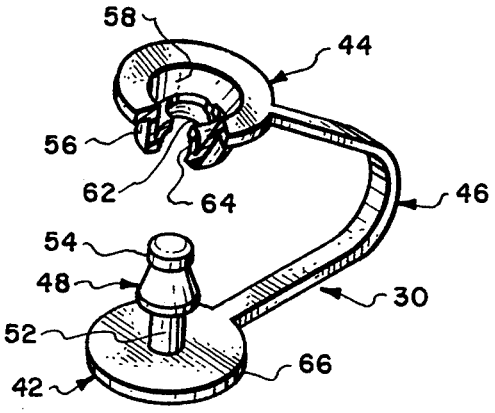
FIG. 2 is an isometric view of the fastener means utilized in conjuction with said band.
Figure 3:
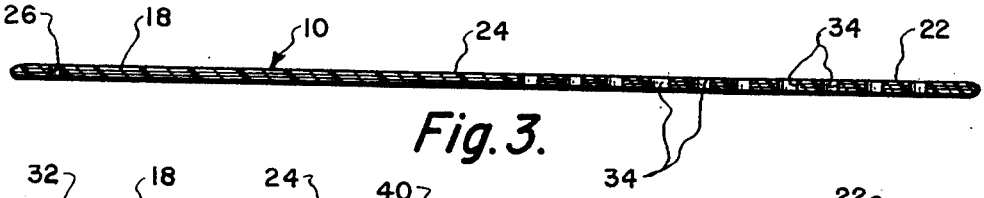
FIG. 3 is a cross-sectional view taken on the broken line 3—3 of FIG. 1.
Figure 4:
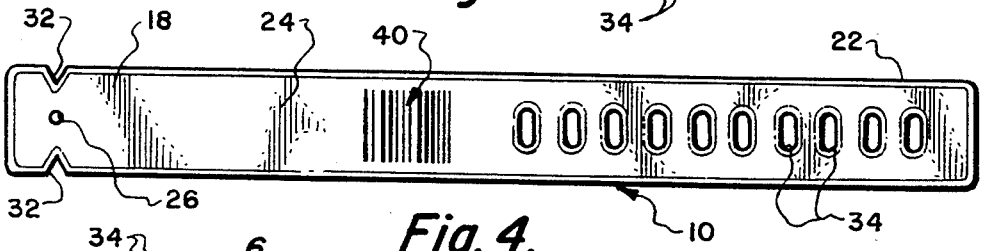
FIG. 4 is a top plan view of the band after the imprinting of a bar code upon the intermediate inscribable portion thereof.

A locking receptacle 56 constitutes the second fastener portion 44 and incorporates a bore 58 which has a locking land 62 at the upper extremity of a frusto-conical reduced bore 64, as best shown in FIGS. 2 and 6 of the drawings. An enlarged circular base 66 supports the detent means 48 and is connected to the tether or hinge means 46.

It is also contemplated that fasteners which consist of two separate parts similar to those disclosed in U.S. Pat. No. No. 2,941,270 be utilized in substitution for the fastener means 30.

Obviously, the length and shape of the band blank 10 will be dictated by the mode of utilization thereof and, particularly, in the case of patient identification, by the expected size of the wrist or ankle of the intended ultimate user. For instance, obviously, baby bands will be much smaller and shorter than the mother bands which frequently accompany them.

Consequently, the number of fastener receiving apertures provided in the second portion or extremity of the band will also be dictated by the size and ultimate intended use of the band.

When the band 10 is to be adjusted and fastened upon the wrist of an individual or upon an article, the fastener means 30 is mounted in operative relationship with the band 10 by inserting the locking head 54 of the detent means 48 through the mounting opening 26. This locates the shaft or cylindrical shank 52 in the mounting opening 26 and the first and second extremities of 18 and 22 of the band 10 can be associated in overlapping relationship with each other to cause one of the elongated openings 34 to be juxtaposed in overlying relationship with the locking head 54.

The locking receptacle 56 is then moved on the tether 46 to receive the locking head 54 which causes the tether 46 to be received in the adjacent recess or receptacle 32 and to urge the second extremity 22 to the left, as best shown in FIG. 6 of the drawings, to permit the tether 46 to be received in the recess 32.

By locating the tether 46 in the recess 32, swivelling or movement of the tether 46 with respect to the perimeter of the band 10 is eliminated and such annoying movements which might cause discomfort to an individual wearing the band is obviated.

Obviously, the band blank may be fabricated individually, but it is susceptible of being fabricated from sheet plastic materials which are fed from rolls and which are susceptible of providing for the multiple fabrication of the bands in edge-to-edge relationship so that they may be supplied to the customer in either sheet or roll form. Multiple band sheets or rolls are particularly adapted to the needs of large hospitals, large entertainment centers, and the like for use, respectively, in patient identification, and crowd control.

Once again, the materials utilized in the band will be dictated, in part, by the ultimate use thereof but, characteristically, it is desirable that the plastic or other sheet materials utilized resist tearing and ripping in order that the bands may not be torn from the wrist of a patient or other person wearing the band.

The material utilized in fabricating the flexible band should be dimensionally stable in that it has a relatively high modulus of elasticity, relatively low yield strength, and relatively high ultimate strength.

As previously mentioned, synthetic plastic sheet materials are particularly adapted for utilization in the band and include polyvinyl chloride plastics and copolymers thereof and various of the acetate resins which are known for their dimensional stability and such characteristics as non-toxicity, softness, and flexibility.

Natural fibrous materials such as resin-reinforced papers, plastic-coated papers, and the like may also be utilized. Available are materials fabricated from polyethylene fibers by an integrated spinning and bonding process where the fibers are self-bonded by heat and pressure to form a sheet eliminating binders, sizers, or fillers.

The flexible band may be fabricated from a single-ply or multiplicity of laminae of materials. A three-laminae flexible band can be fabricated from an intermediate lamina of self-bonded polyethylene hyper-plastic, polyethylene terephthalate resin or an unplasticized bi-axially oriented polyvinyl chloride lamina disposed between two synthetic plastic laminae.

In any event, in the present application, it is desirable that the surface of the band 10 which is intended to be imprinted by the bar code 40 be fabricated from one of a variety of plastic materials which will receive such an imprint as is well known to those skilled in the art.

The Method of Utilizing the Embodiment of FIGS. 1–6

Figure 5:
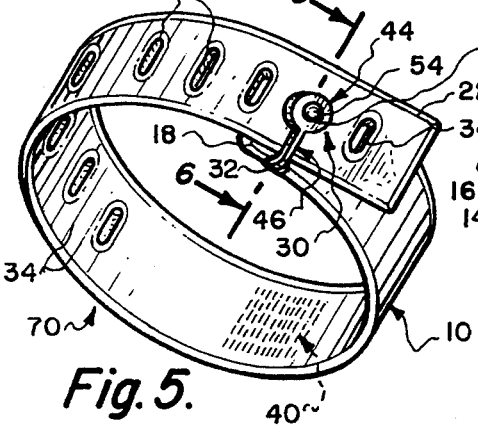
FIG. 5 is an isometric view of the identification device.

The identification device 70 is shown in FIGS. 5 and 6 with the fastener means 30 assembled in locking relationship upon the band 10 which is no longer blank but bears the imprinted bar code 40 or multiple bar codes.

When the identification device is to be installed upon the wrist or ankle of the user or about an inanimate object, the locking head 54 of the detent means 48 is forced through the reduced diameter mounting opening 26 in the first portion or extremity 18 of the band 10 and the shaft 52 extends through the reduced diameter mounting opening 26 in the first extremity 18 of the band 10 and is maintained in operative relationship with the band by the constrictive effect of the materials defining the perimeter of said opening and the larger diameter of the locking head 54.

With the fastener means 30 so installed, the second extremity 22 of the band 10 is overlapped on the first extremity 18, as best shown in FIG. 5 of the drawings to register one of the openings 34 with the upwardly projecting detent means 48 so that the identification device 70 is properly fitted upon the person or article upon whom or which it is being installed.

When the selected opening 34 is juxtaposed to the head 54 of the detent means 48, said head can be inserted through said opening and the tether or hinge means 46 folded over to juxtapose the locking receptacle 56 to the head 54 and the locking receptacle 56 is then pressed downwardly over the head to cause the underside of said head to engage the locking land 62. When so engaged, the fastener means 30 resists disengagement from operative relationship with the band 10 and, consequently, removal of the band 10 from operative engagement with the desired person or object.

When the tether or hinge means 46 is folded over into the position shown in FIGS. 5 and 6, the intermediate portion of the tether is engaged in the adjacent fastener locating recess 32 to prevent the tether or hinge means 46 from being inadvertently displaced with respect to the associated edge of the band 10. This eliminates annoying movement of the tether or hinge means 46 which might cause a distraction to the individual wearing the identification means 70.

Alternative Embodiments of the Invention

An alternative embodiment of the invention is shown in FIGS. 7–10, as identification device 80 which includes a band 82 generally similar to the band 10 previously discussed. The same reference numerals will be utilized to indicate the elements of the band 82 which are found in the previously disclosed band 10.

The band 82 is shown as incorporating the bar code 40 and not in its blank, original form before imprinting. The major difference between the band 10 and band 82 is that the second portion or extremity 22 of the band 82 is imperforate.

Figure 8:
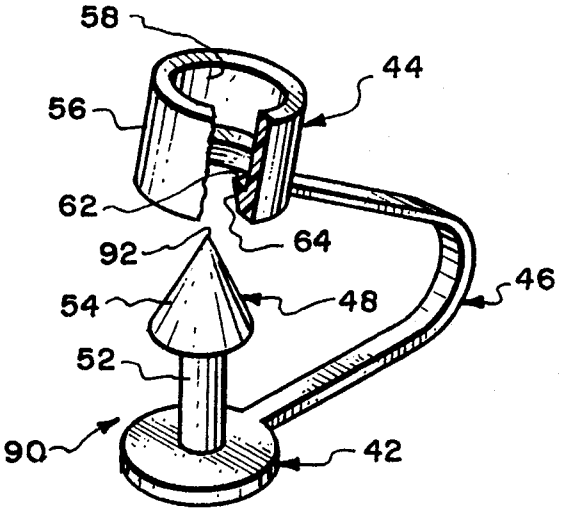
FIG. 8 is an isometric, partly sectional view of the fastener means utilized in conjunction with the band of FIG. 7.
Figure 10:
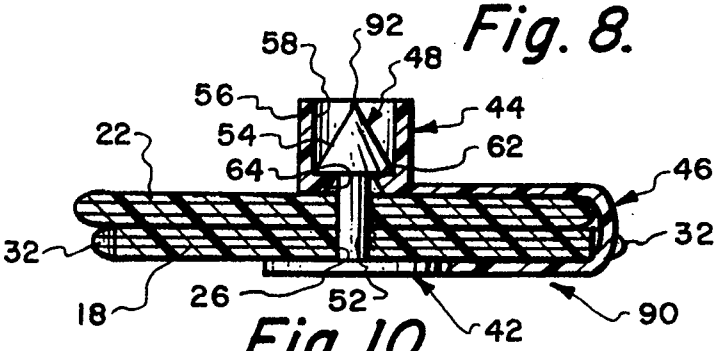
FIG. 10 is a transverse sectional view taken on the broken line 10—10 of FIG. 9.

Co-acting with the band 82 is fastener means 90, FIG. 8, which includes a first fastener portion 42 and a second fastener portion 44 integrally connected with each other by tether or hinge means 46. Detent means 48 includes a cylindrical shank 52 having an integrally formed locking head 54 provided upon the upper extremity thereof. The locking receptacle 56 is similar to that of the fastener means 30 and co-acts with the locking head 54 in substantially the same manner.

However, the locking head 54 differs from the locking head 54 of the fastener 30 in that it is truly conical and incorporates a piercing extremity 92.

Therefore, when the identification means 80 is installed upon the wrist of a user, there is no necessity to hunt for one particular fastener receiving opening because, when the overlying second extremity 22 of the band 80 is properly located, the piercing extremity 92 can be forced through the band to create the desired opening in the band and to secure the band 82 in operative relationship with a wide range of wrist sizes.

Figure 11:
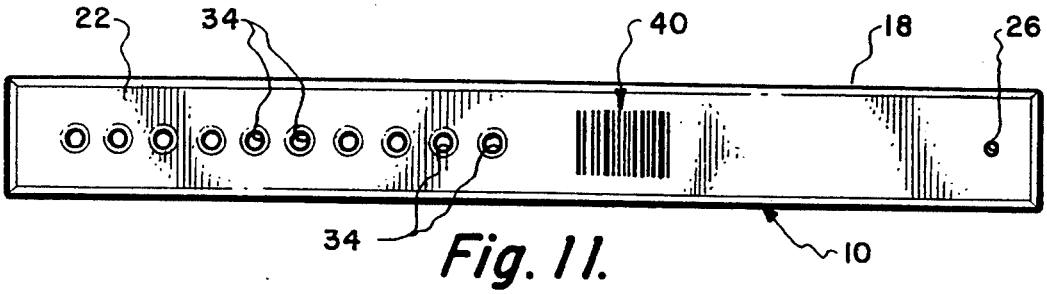
FIG. 11 is a plan view of a band blank.
Figure 12:
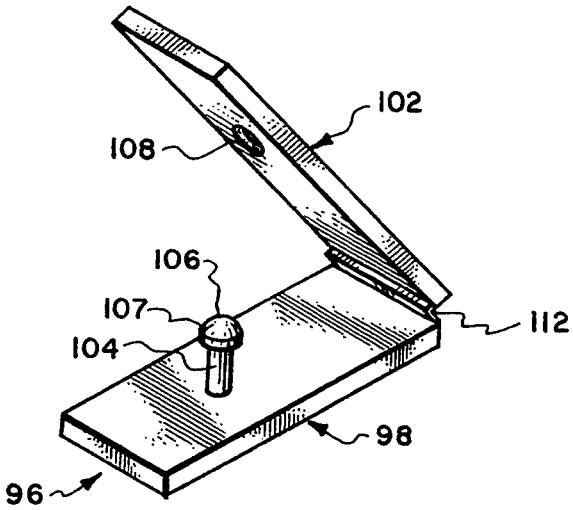
FIG. 12 is an isometric view of an alternative form of fastener means for use in conjunction with said blank.
Figure 13:
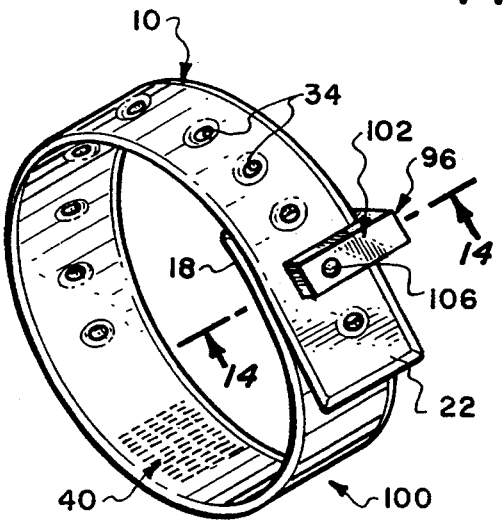
FIG. 13 shows the fastener means of FIG. 12 in assembled, locking relationship with the band blank of FIG. 11.
Figure 14:
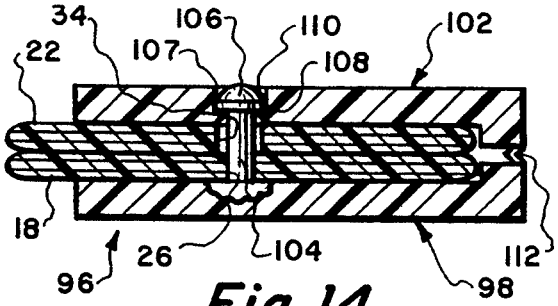
FIG. 14 is a transverse sectional view taken on the broken line 14—14 of FIG. 13.
Figure 15:
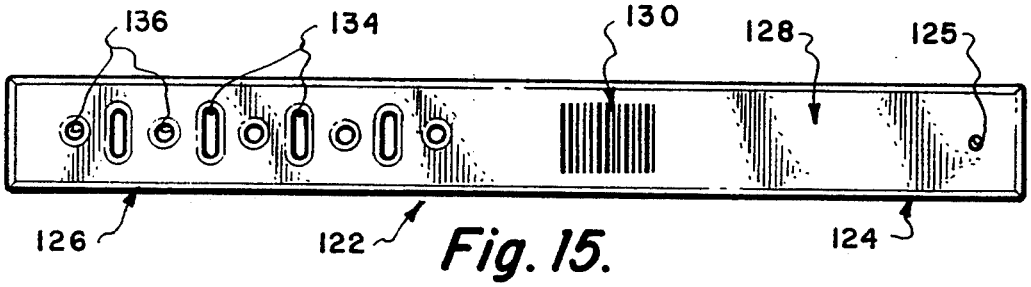
FIG. 15 is an alternative form of the band blank of the invention.

The alternative embodiment 100 of the identification device, FIGS. 11–14, incorporates a band 10 identical with that previously disclosed, said band being shown in FIG. 11 of the drawings with the bar code 40 imprinted thereupon.

However, the fastener means 96 differs from the previously disclosed fastener means in that it is generally rectangular in configuration as are its component first and second fastener portions 98 and 102. Formed integrally with the first fastener portion 98 is a shaft 104 having a cylindrical locking head 106 thereupon, said locking head having a radius 107 thereupon to facilitate the entry thereof into a bore 108, said shaft and locking head being cooperative with said bore located in the second fastener portion 102 so that when said second fastener portion is lowered into overlying relationship with the second extremity 22 of the band 10, the locking head 106 may be forced through the locking bore 108 into a locking receptacle 110.

The two portions 98 and 102 of the fastener 96 are maintained in operative relationship with each other by integral tether or hinge means 112.

During the fastener installation process, the locking head 106 is forced through the smaller fastener mounting opening 26, and then the locking head 106 is inserted through a selected one of the fastener receiving openings 34. The locking head 106 then projects above the upper surface of the second extremity 22 of the band 10 and the second fastener portion 102 is lowered to force the locking head 106 through the bore 108 and into seating engagement in the locking receptacle 110.

The difference in the diameters of the locking head 106 and bore 108 is accommodated by the relative compressibility of the synthetic plastic from which the fastener 96 is fabricated but, once the locking head 106 is seated in the locking receptacle 110, permanent securement of the fastener 96 in operative relationship with the band 10 is accomplished. It will be noted that the fastener 96 is designed to partially span the band 10 normally to the longitudinal axis of the band 10.

An alternative embodiment of the identification device is shown at 120 in FIGS. 15–18 of the drawings as incorporating a band 122 having a first portion or extremity 124 and a second portion or extremity 126, there being an intermediate inscribable area 128 on said band. The band 122 is shown as having a bar code 130 inscribed thereupon, but it will be understood that the band 122 is normally provided in blank form with the bar code 130 to be subsequently inscribed upon the intermediate inscribable area.

Formed in the first portion 124 of the band 122 is a fastener mounting opening 125. Located in the second portion or extremity 126 of the band 122 is a plurality of elongated, transversely oriented first fastener receiving openings 134, said fastener receiving openings having second fastener receiving openings 136 interspersed between said receiving openings 134.

Figure 16:
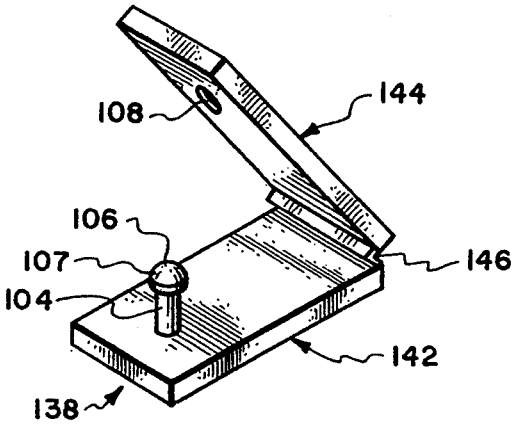
FIG 16 is an isometric view of fastener means specifically intended for use with the band blank of FIG. 15.
Figure 17:
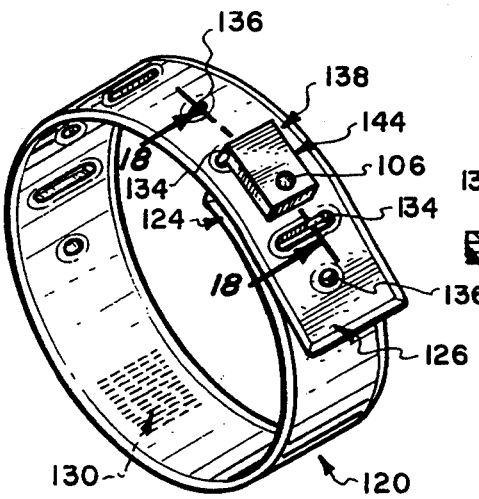
FIG. 17 shows the fastener means of FIG. 16 installed in locking relationship with the band blank of FIG. 15.
Figure 18:
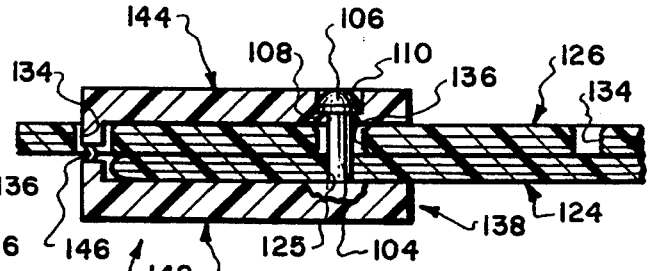
FIG. 18 is a transverse sectional view taken on the broken line 18—18 of FIG. 17.

A fastener 138 is shown in FIGS. 16–18 of the drawings as having a first portion 142 and a second portion 144 connected by an integral hinge 146. The fastener 138 is generally similar in its construction to the fastener 96 previously discussed and, therefore, like reference numerals are utilized to describe the similar components of the two fasteners.

Furthermore, the operation of the fasteners 96 and 138 is essentially similar with a few major distinctions.

Prior to the insertion of the second portion 144 of the fastener 138 through the elongated opening 134, the locking head 106 has been inserted through the small mounting opening 125 in the first extremity or portion 124 of the band 122. Opening 134 is selected as being located adjacent the fastener receiving opening 136 which is to receive the shaft 104 and locking head 106.

Simultaneously with the insertion of the second portion 144 of the fastener 138 through the chosen mounting opening 134, the locking head 106 is inserted through the adjacent fastener receiving opening 136 and the second fastener portion 144 urged downwardly to engage the locking head 106 in the locking receptacle 110 in the same manner as previously disclosed in discussing the operation of the fastener 96.

Another distinction between the operation of the fastener 96 and the fastener 138 lies in the fact that the fastener 138 has its longitudinal axis coincident with the longitudinal axis of the band 122 and the fastener 138 is, thus, located entirely within the body of the band.

Another aspect of the construction of the fastener 138 is that the detent means constituted by the shaft 104 and locking head 106 and the bore 108 and locking receptacle 110 must be spaced with reference to the hinge 146 so that the distance between the vertical axis of the shaft 104 and the hinge 146 is equal to the distance between the centers of the elongated openings 134 and fastener receiving openings 136.

A further alternative embodiment, not shown, does not require the opening 125 in the first extremity 124, but instead includes the operative attachment of the fastener 138 to the first extremity 124 by the use of sonic-welding, adhesive, stapling or similar expedient. Such an alternative embodiment could include, for example, the first portion 142 disposed between the first extremity 124 and the second extremity 126 when the embodiment is assembled.

An additional embodiment 150 of the identification device is disclosed in FIGS. 19–22 as including the band 82 previously disclosed in conjunction with the identification device 80. Therefore, like reference numerals are utilized in disclosing the embodiment 150, so far as the band 82 is concerned.

Figure 7:
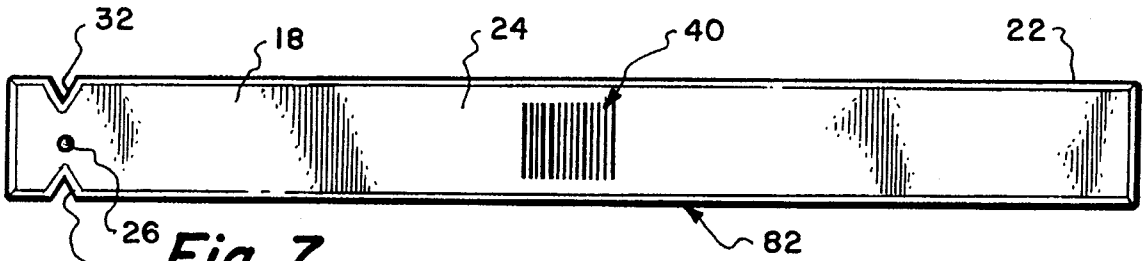
FIG 7 is a top plan view of a band blank of an alternative embodiment of the invention.
Figure 9:
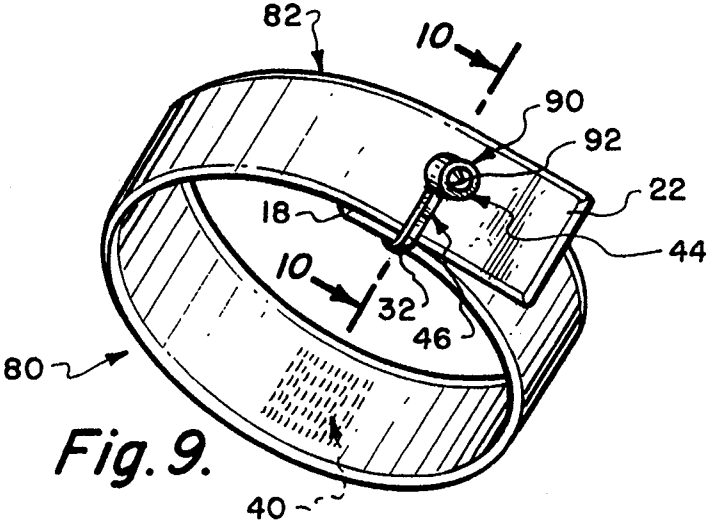
FIG. 9 is a view showing the fastener means of FIG. 8 in assembled and locking relationship with the opposite extremities of the band.
Figure 19:
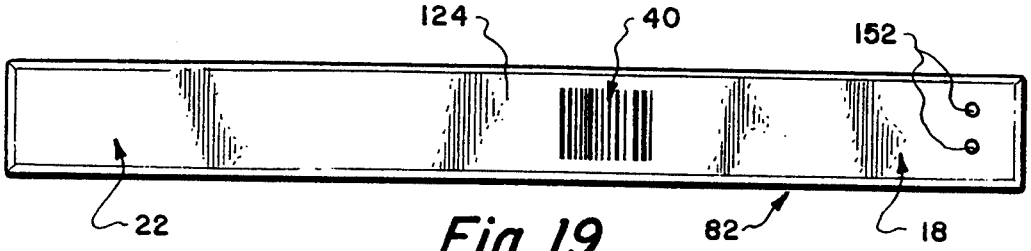
FIG. 19 is a plan view showing an alternative form of band blank.
Figure 20:
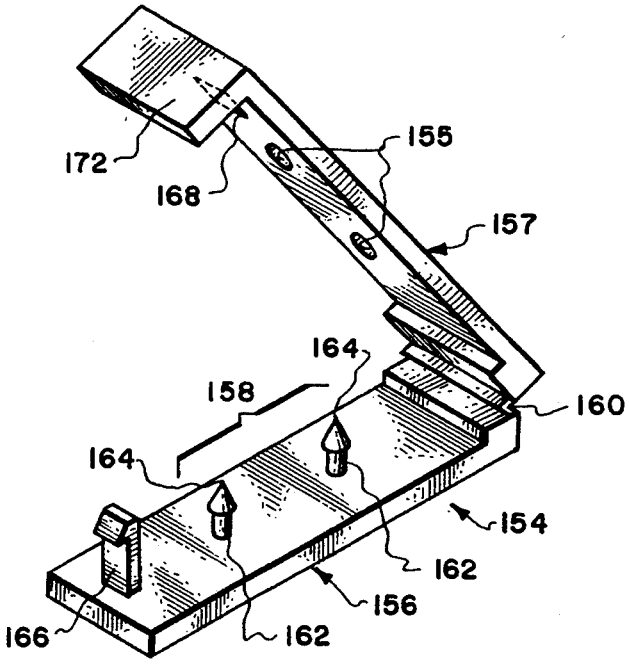
FIG. 20 is an isometric view showing an alternative fastener configuration.

One difference between the originally disclosed band of FIG. 7 and the band 82 of FIG. 19 lies in the provision of two small fastener receiving and mounting openings 152. Other than the provision of the fastener receiving openings 152, the band 82 is imperforate. Cooperative with the band 82 is fastener means 154 which includes a first rectangular portion 156 and a second rectangular portion 157 connected by integral hinge means 160. The second fastener portion 157 has circular recesses 155 in the underside thereof.

Formed on the first fastener portion 156 is detent and locking means generally indicated at 158 and including two locking prongs 162 having locking heads 164, said locking heads 164 being capable of piercing the material from which the band 82 is fabricated. Also constituting a part of the detent and locking means is locking member 166 which engages in a corresponding locking receptacle 168 formed in the extremity of the second fastener portion 157. A depending flange 172 is formed on the free extremity of the second fastener portion 157 and prevents access to the locking member 166 when the locking member is engaged in the locking detent 168, as best shown in FIG. 22 of the drawings.

Figure 21:
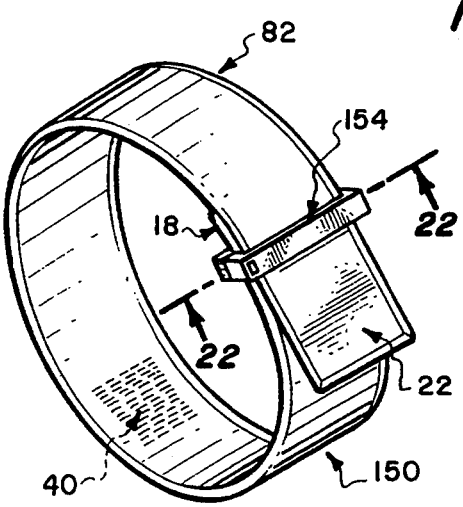
FIG. 21 shows the fastener of FIG. 20 installed in locking relationship with the band blank of FIG. 19.
Figure 22:
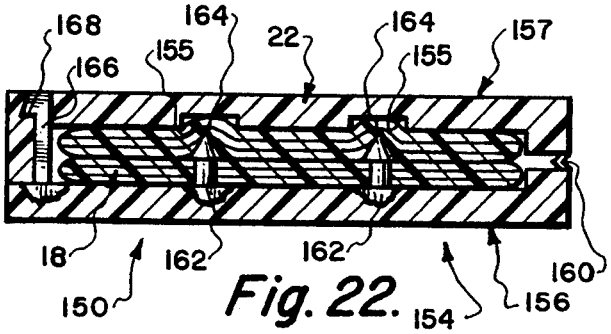
FIG. 22 a transverse sectional view taken on the broken line 22—22 of FIG. 21.

To install the fastener 154 in the operative relationship shown in FIGS. 21 and 22 of the drawings, the piercing and detent heads 164 are forced through the small mounting openings 152 in the first extremity of the band 82, the band is then wrapped around the wrist or other body or article portion with the second extremity 22 disposed in overlying relationship with the piercing heads 164. Then the second fastener portion 157 is forced downwardly to simultaneously cause the piercing heads 164 to partially pierce the second extremity 22 and also cause the locking engagement of the locking member 166 with the locking receptacle recess 168. The heads 164 urge the material of the second extremity 22 into the recesses 155 as best shown in FIG. 22.

Figure 23:
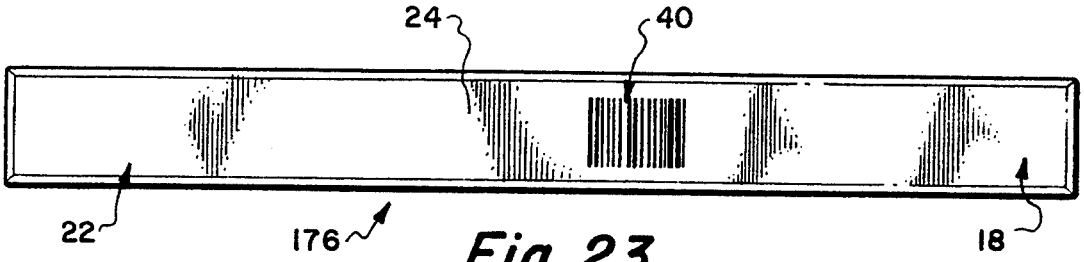
FIG. 23 is an alternative form of band shown in plan.
Figure 25:
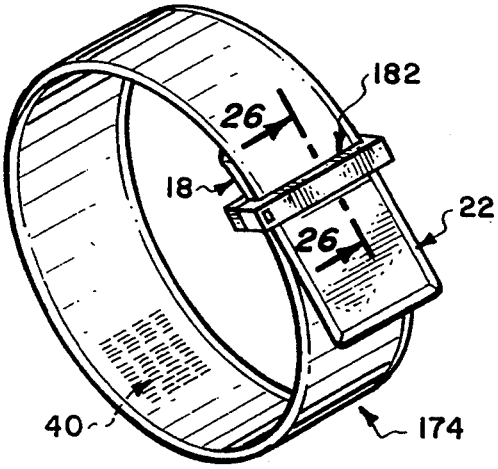
FIG. 25 is a view showing the fastener means of FIG. 24 installed in operative relationship with the band of FIG. 23.
Figure 26:
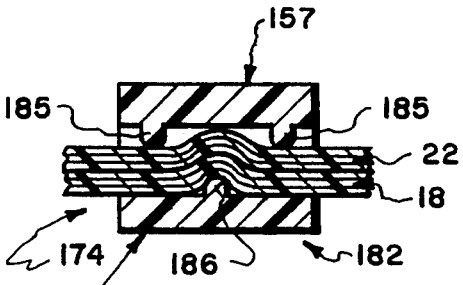
FIG. 26 is a transverse sectional view taken on the broken line 26—26 of FIG. 25.

Another embodiment of the identification device is shown at 174 in FIGS. 25 and 26 of the drawings as including a band 176, FIG. 23, which includes first and second extremities 18 and 22 and an intermediate inscribable portion 24 having a bar code 40 imprinted thereupon.

Figure 24:
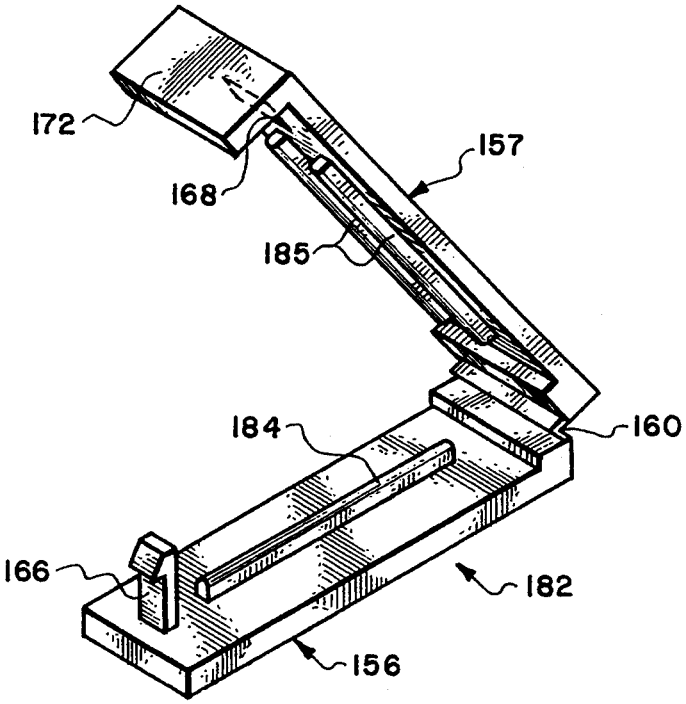
FIG. 24 is a fastener means intended for utilization in conjunction with the band of FIG. 23.

A fastener 182, FIG. 24, cooperates with the band 176 and is essentially similar to the previously disclosed fastener 154 with the exception that a compression bar 184 is provided on the upper surface of the first fastener portion 156 which extends substantially the full length of said portion.

Formed on the underside of the second fastener portion 157 are spaced ribs 185. Ribs 185 are shown in FIG. 26 as being of a length comparable to the compression bar 184; those skilled in the art, however, will understand that the ribs 185 may be of any suitable length, including being segmented. Similarly, the compression bar 184 may be segmented or provided in any suitable configuration.

When the identification device 174 is to be secured on a user or an object, the first and second extremities 18 and 22 of the band 176 are overlapped and the fastener 182 is disposed transversely of the overlap, FIG. 25. The first extremity 18 of the band 176 thus overlies the compression bar 184 and the second extremity 22 is adjusted until the proper tightness of the band 176 is accomplished.

The second fastener portion 157 is then urged downwardly to bring the ribs 185 into overlying relationship with the upper surface of the second extremity or portion 22 of the band and, as downward movement of the second fastener portion 157 occurs, the upper surface or portion of the second extremity 22 of the band is forced into the receptacle or recess defined by the ribs 185 to provide a positive lock thereupon. In addition, the locking member 166 is caused to engage in the locking recess or receptacle 168, as best shown in FIG. 24 of the drawings.

Figure 27:
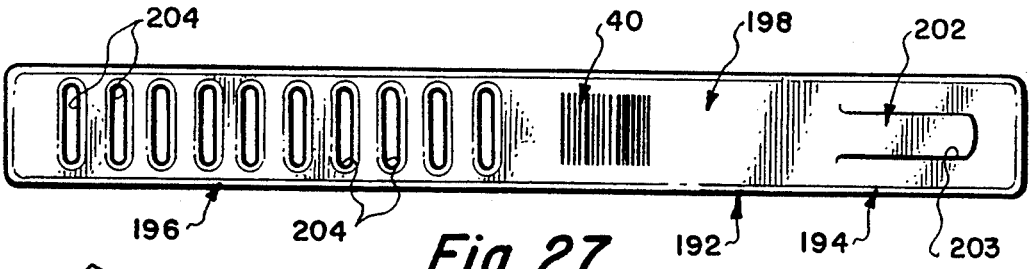
FIG. 27 is an alternative band configuration shown in plan.
Figure 28:
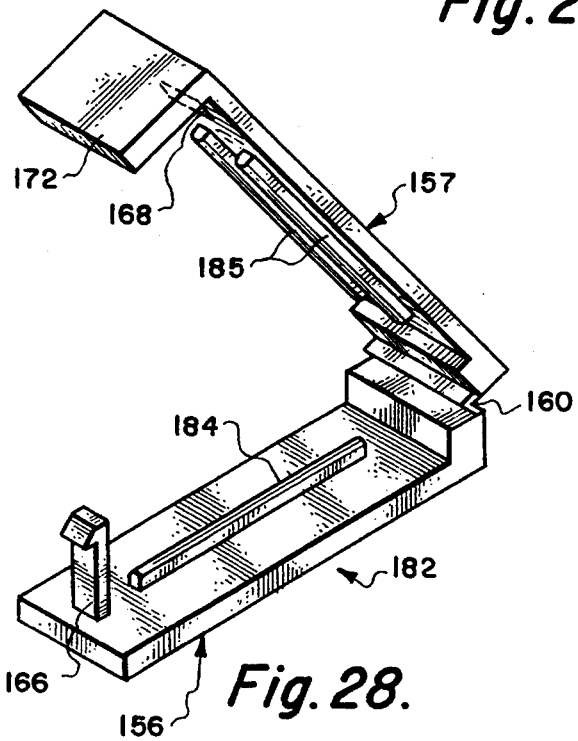
FIG. 28 is an isometric view showing the fastener means utilized in conjunction with the band of FIG. 27.
Figure 30:
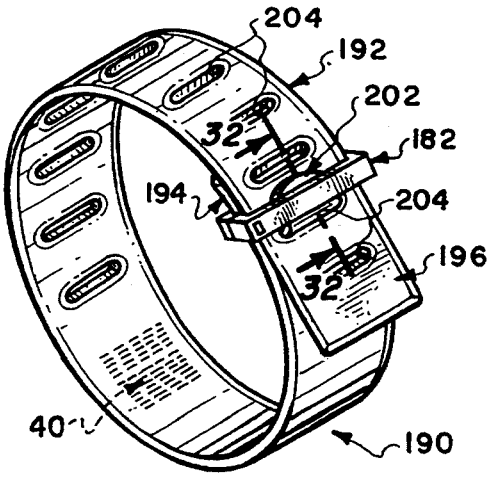
FIG. 30 illustrates the installation of the fastener means of FIG. 28 on the band of FIG. 27.
Figure 31:
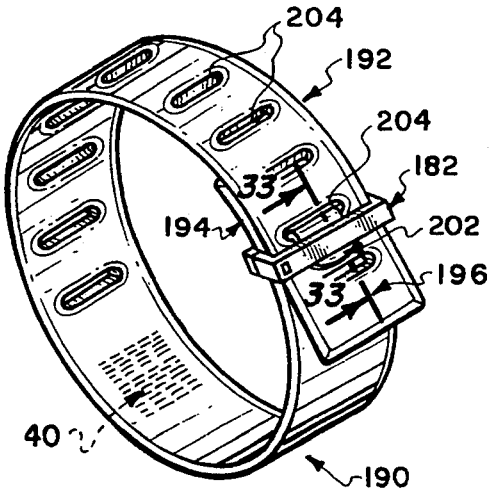
FIG. 31 is a view similar to FIG. 30 but showing a reverse installation of the tab means.

Another embodiment of the identification device is shown at 190 in FIGS. 30 and 31 of the drawings, said device including an elongated band 192, FIG. 27, having a first end portion or extremity 194 and a second end portion or extremity 196. An intermediate inscribable portion 198 is imprintable with a bar code 40.

A flexible band securement flap or tab 202 is formed in the first extremity or portion 194 by die cutting or similar operations while a plurality of linearly spaced elongated tab receiving slots 204 is provided in the second portion or extremity 196 of the band 192 and formed in a similar manner. When the tab 202 is lifted, an elongated opening 203 is created in the band 192.

Figure 29:
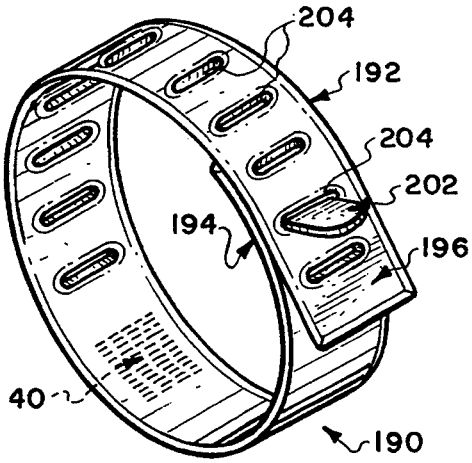
FIG. 29 discloses the manner in which the end portions or extremities of the band are initially engaged upon each other to encompass an object.

The installation of the band 192 entails the wrapping of the band 192 about the relevant portions of the person or object to be identified and the insertion of the tab 202 through a selected opening 204. This operation is best shown in FIG. 29 of the drawings.

After the tab has been so inserted, the fastener 182 can be disposed transversely of the band 192 with the portion 157 in overlying relationship with the tab 202 and the portion 157 of the fastener 182 then urged downwardly to cause the tab 202 to be forced between the ribs 185 (by the compression bar or bars 184) with the first extremity 194 and the second extremity 196 of band 192 thus locking the band.

FIGS. 30 and 31 show alternative opposite dispositions of the tab with reference to the second extremity 196 of the band 10.

Figure 32:
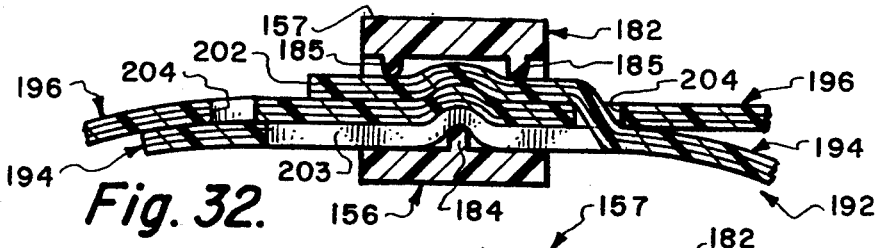
FIG. 32 is a transverse sectional view taken on the broken line 32—32 of FIG. 30.
Figure 33:
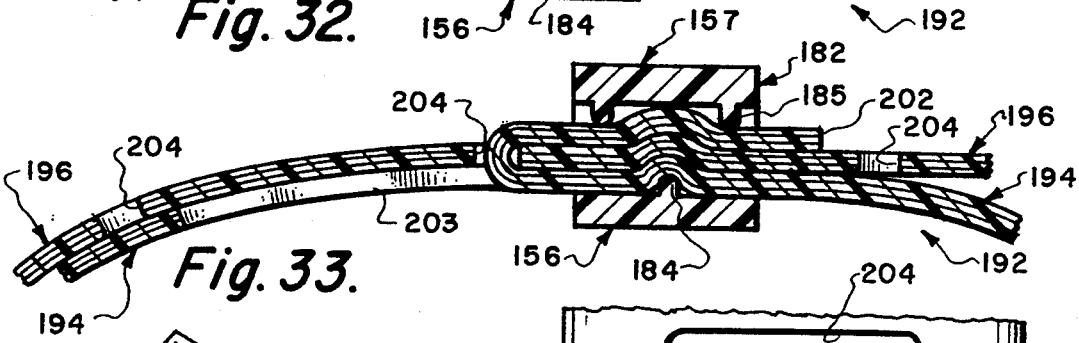
FIG. 33 is a view taken on the broken line 33—33 of FIG. 31.
Figure 34:
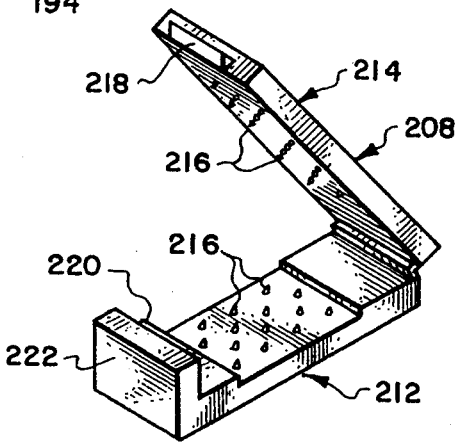
FIG. 34 is an isometric view of alternative fastening means.

The compression bar 184 extends upwardly and biases the first band extremity 194 upwardly, as best shown in FIGS. 32 and 33 of the drawings, thus causing the tab 202 to be locked between the bars 185 to retain it in locking relationship with the upper surface of the second extremity 196 of the band 192.

Other alternative embodiments of the invention, not shown, would include providing the compression bar 184 in a length no greater than the width of the tab 202. The height of the compression bar 184 would be determined by whether it was to be applied at a location on the assembled band so as to compress one or two "layers" of the band, as now described.

In the first such alternative embodiment (that is, in the embodiment in which the compression bar 184 is to compress two "layers" of the band, the fastener 182 is positioned laterally along the assembled band similarly to the position illustrated in FIG. 32. Because the compression bar 184 in this embodiment is provided in a length no greater than the width of the tab 202, however, the compression bar fits through the elongated opening 203 instead of compressing the sides of that opening as shown in FIG. 32. Thus, in this embodiment, the compression bar 184 would compress two "layers" (rather than the three "layers" shown in FIG. 32)—the second extremity 196 and the tab 202.

The second such alternative embodiment would include an assembly similar to that shown in FIG. 32, but would include positioning the fastener 182 laterally farther to the right along the assembled band (in the view illustrated in FIG. 32) so that the compression bar 184 protruded through the selected opening 204, along with the tab 202. In such an embodiment, the compression bar 184 would necessarily be "taller" (that is, it would extend upwardly a greater distance) than the view shown in FIG. 32, in order to provide the desired gripping contact. Those skilled in the art will understand, in addition, that such an embodiment would involve the compression bar 184 acting to compress only one "layer"—the tab 202. In this embodiment, the desired "locking" of the band at a selected, fixed size is accomplished by the combination of the gripping of the tab 202 and the lateral interference of the compression bar 184 in the selected opening 204 (which prevents the fastener 182 from sliding to the right or the left in the view shown in FIG. 32).

Figure 37:
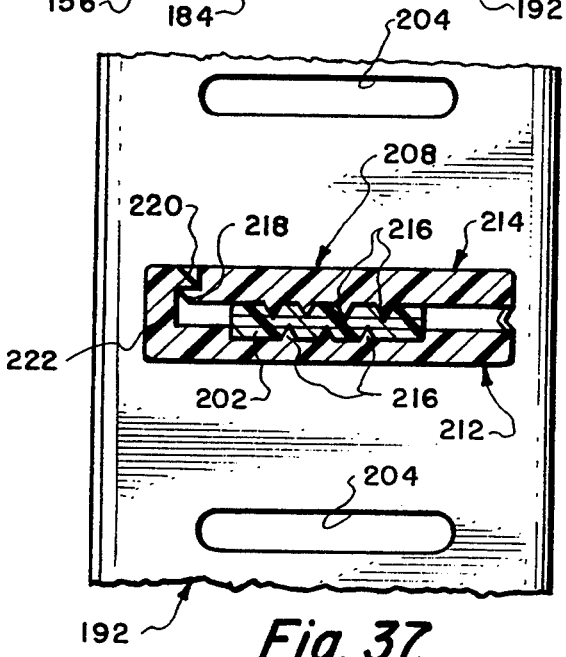
FIG. 37 is a transverse sectional view taken on the broken line 37—37 of FIG. 36.
Figure 35:
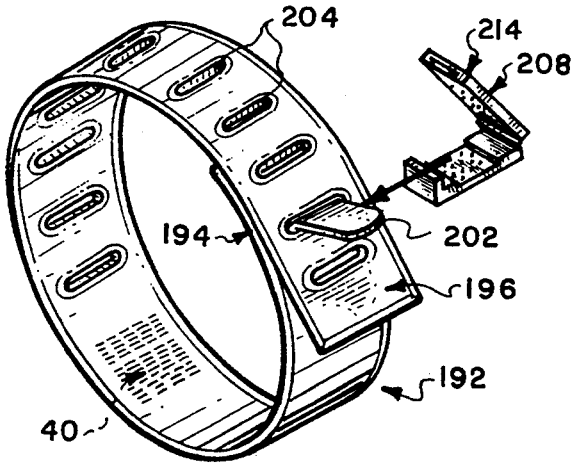
FIG. 35 shows the band blank of FIG. 27 in conjunction with fastener means of FIG. 34.
Figure 36:
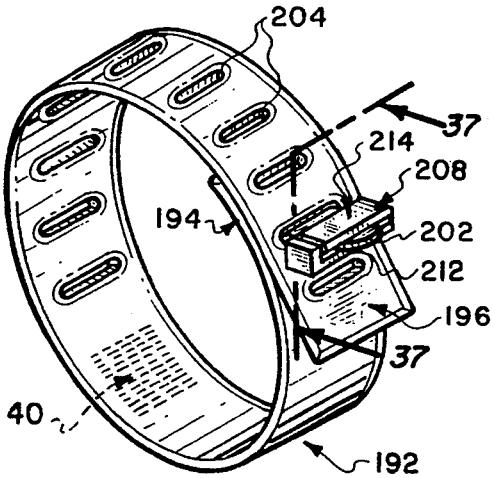
FIG. 36 shows the fastening means of FIG. 34 installed in operative relationship with the band of FIG. 27.
Figure 38:
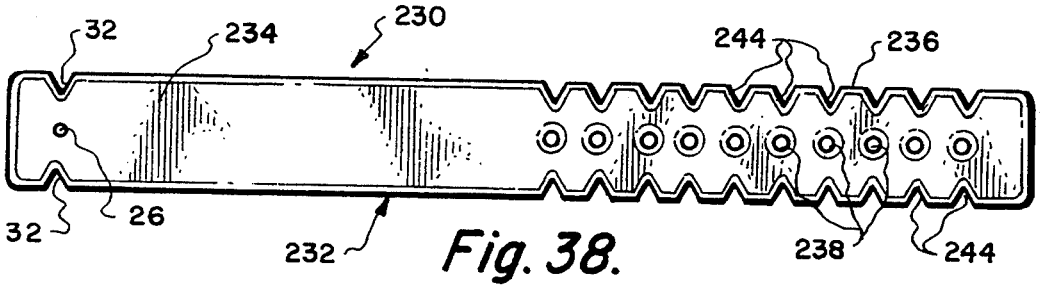
FIG. 38 is a plan view of an alternative band of the invention.
Figure 39:
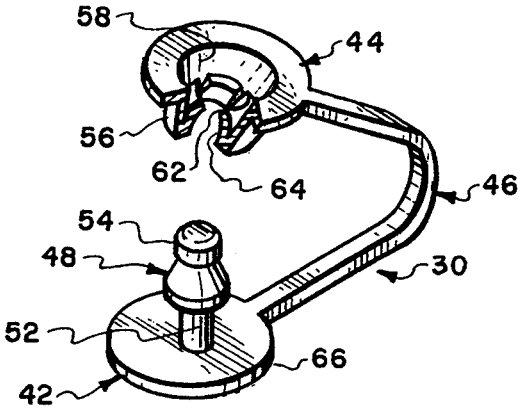
FIG. 39 is an isometric view of a fastener for use in conjunction with the band of FIG. 38.
Figure 40:
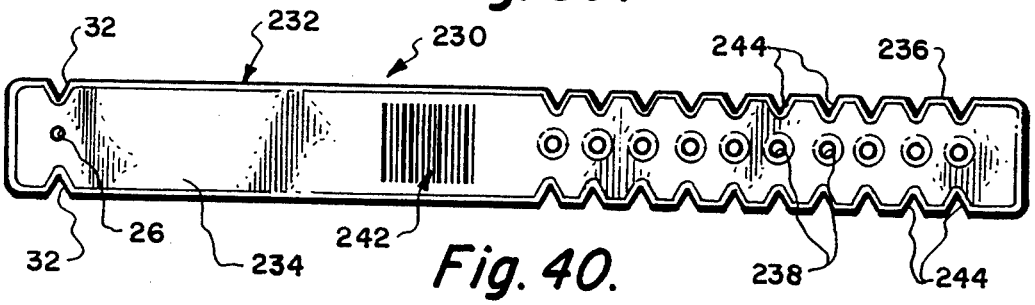
FIG. 40 is a view showing the band with the bar code applied thereto.

An alternative configuration fastener means 208 includes a first portion 212 and a second portion 214, said first and second portions having integrally formed piercing pins 216 formed on the confronting surfaces thereof. A detent 218 engages a corresponding locking land 220, FIG. 37, to secure the fastener 208 upon the tab 202, as best shown in FIGS. 35–37 of the drawings.

An alternative embodiment 230 of the identification device is shown at FIGS. 38–42 of the drawings as including a band 232 and a fastener 30 identical with the fastener 30 disclosed hereinbelow.

The band 232 has a first extremity or portion 234 and a second extremity or portion 236. The second extremity 236 incorporates a plurality of fastener receiving openings 238 and an intermediate bar code portion 242 is provided on the band 232. Detent receptacle 32 provided in the first extremity or portion of the band 232 and corresponding receptacles 244 are provided in the second portion or extremity thereof to mate with the receptacles 32 when the band encompasses an object or body portion, and is secured in operative relationship therewith by the fastener means 30.

Figure 41:
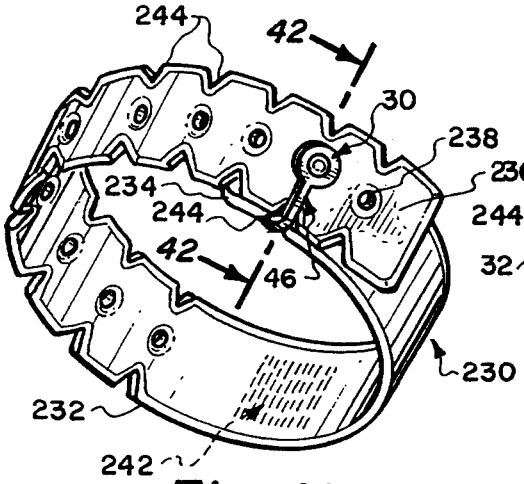
FIG. 41 shows the identification device with the components thereof assembled in operative position.
Figure 42:
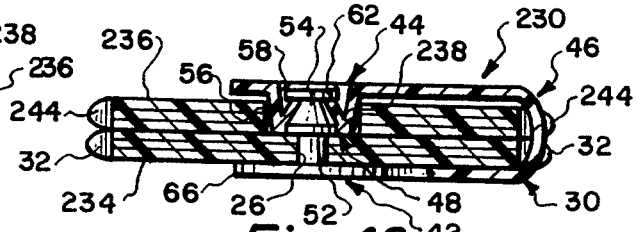
FIG. 42 is a transverse sectional view taken on the broken line 42—42 of FIG. 41.

As best shown in FIGS. 41 and 42, the fastener means 30 is adapted to be assembled with the band 232 in the same manner as the embodiment shown in FIGS. 1–6 of the drawings with the exception that the tether 46 is received in the super-imposed detent receptacles 32 and 244. This eliminates the necessity for elongating the openings 238 and for displacing the relative extremities of the band 232 with respect to each other.

We thus provide, by our invention, an identification device which is characterized by the fact that the band included in the device can be readily imprinted with a bar code or similar identification means. Also, within the concept of the invention is the provision of a separate fastener means which is cooperative with the structure of the band so that it can be readily and permanently installed upon the relevant portion of an individual or object being identified.

We claim:

1. In an identification device: an elongated, flexible band for encircling an object to be identified, said flexible band being of uniform width along its entire length and having a first end portion, an intermediate portion, a second end portion, and top and bottom surfaces said intermediate portion having an imprintable surface thereupon for receiving a bar code imprint and said second end portion being engagable with said first end portion in overlapping relationship determined by the size of said object; securement means engagable with corresponding surfaces of said first and second end portions, said securement means including a first securement portion engagable with the bottom surface of said first end portion of said band and having connector means integral therewith, said connector means securing a second securement portion to said first securement portion, whereby, when said second securement portion is disposed in overlying relationship with the top surface of said second end portion of said band, said first and second securement portions will be permanently secured to each other and in locking engagement with said first and second end portions of said band; and a recess in an edge of said first end portion for receiving said connector means to hold said connector means against swiveling movement on said band.

2. The device of claim 1, further including detent means operably disposed on said first or said second securement portion of said securement means, said detent means being engagable with said first and said second end portions of said band to maintain said first end portion in operative relationship with said second end portion thereof and to maintain said first and second securement portions in permanent relationship with each other and the bottom surface of said first and the top surface of said second end portions.

3. The device of claim 1 in which said first end portion of said band is provided with a securement means mounting opening and said second end portion is provided with a plurality of linearly spaced openings, further including detent means operably disposed on said first or said second securement portions of said securement means, said detent means being insertable through said mounting opening and engagable with a selected one of said linearly spaced openings when said band is disposed in encompassing relationship with an object and the respective end portions of said band are disposed in overlapping relationship, said detent means being engagable in locking relationship with the other of said first or said second securement portions of said securement means to maintain the overlapping first and second end portions of said band in permanent relationship with each other.

4. In an identification device: an elongated band securable about an object to be identified, said band being flexible and of uniform width along its entire length and having a first end portion and a second end portion having opposite edges and top and bottom surfaces, said first end portion incorporating a mounting opening and tether locating recesses in the opposite edges of said first end portion, said second end portion incorporating a plurality of linearly spaced openings; and fastener means having a first fastener portion incorporating a detent and a second fastener portion having a receptacle permanently engagable by said detent, said first and second fastener portions being secured to each other by a flexible tether and said detent on said first fastener portion being engagable with and extending through said mounting opening when said first and second end portions of said band are disposed in encompassing relationship with an object and in overlapping relationship with each other so that said detent extends through a selected one of said linearly spaced openings and said receptacle is engaged by said detent to secure said detent permanently in said receptacle and said fastener means in permanent securement with said first and second end portions of said band, said tether being received in one of said recesses in said first end portion of said band.

5. The device of claim 4 in which said first and second fastener portions are formed integrally with said tether.

6. The device of claim 4 in which said fastener detent and said receptacle are either or both momentarily deformable to permit the locking engagement thereof.

* * * * *